US006691481B2

(12) United States Patent
Schmidt

(10) Patent No.: US 6,691,481 B2
(45) Date of Patent: Feb. 17, 2004

(54) CORNER FORM FOR MODULAR INSULATING CONCRETE FORM SYSTEM

(76) Inventor: Donald L. Schmidt, 425 Second Ave., SW., Oronoco, MN (US) 55960

( * ) Notice: Subject to any disclaimer, the term of this patent is extended or adjusted under 35 U.S.C. 154(b) by 31 days.

(21) Appl. No.: 09/932,095

(22) Filed: Aug. 20, 2001

(65) Prior Publication Data

US 2003/0033776 A1 Feb. 20, 2003

(51) Int. Cl.[7] ..... E04B 2/00; E04B 1/02; E04G 23/00; E04C 1/00

(52) U.S. Cl. ..... 52/425; 52/426; 52/309.11; 52/741.13; 52/562; 52/565

(58) Field of Search ..... 52/309.11, 425, 52/426, 565, 562, 610, 604, 592.6, 431, 432

(56) References Cited

U.S. PATENT DOCUMENTS 4,321,779 A * 3/1982 Kratchmer
4,706,429 A 11/1987 Young
4,866,891 A 9/1989 Young
4,916,879 A * 4/1990 Boeshart
4,949,515 A 8/1990 Krecke
5,311,718 A * 5/1994 Trousilek
5,535,565 A * 7/1996 Majnaric
5,658,483 A * 8/1997 Boeshart
5,896,714 A * 4/1999 Cymbala
6,170,220 B1 * 1/2001 Moore
6,314,694 B1 * 11/2001 Cooper
6,363,683 B1 * 4/2002 Moore

* cited by examiner

*Primary Examiner*—Carl D. Friedman
*Assistant Examiner*—Kevin McDermott
(74) *Attorney, Agent, or Firm*—Siemens Patent Services, LC

(57) ABSTRACT

A corner form for forming concrete having panels connected by a plurality of tie brackets. Each panel comprises a short led and a long leg. The exterior panel has an eighteen inch long, and a thirty inch long leg. The panels have projections formed in the upper surface and corresponding, vertically aligned notches formed in the lower surface. The projections and notches receivingly cooperate to interlock with one another and vertically align the tie brackets. The corner forms are configured such that the long and the short legs enable alternating, overlapping projections of succeeding courses. The tie brackets, each having perpendicularly arranged flat plates extending the full height of the form, are spaced apart twelve inches on centers, measured from the corner edge of the exterior panel. A vertical bracket is optionally embedded in the corner of the exterior panel. The combination of the above inventive features constitute the novel corner form.

20 Claims, 3 Drawing Sheets

CORNER FORM FOR MODULAR INSULATING CONCRETE FORM SYSTEM

REFERENCE TO RELATED APPLICATIONS

This application is related to application Ser. Nos. 09/932,081 entitled MODIFIED FLAT WALL MODULAR INSULATED CONCRETE FORM SYSTEM and 09/932,096 entitled FORM BRACING TIE BRACKET FOR MODULAR INSULATING CONCRETE FORM SYSTEM AND FORM USING THE SAME, filed concurrently herewith on Aug. 20, 2000.

BACKGROUND OF THE INVENTION

1. Field of the Invention

The present invention relates to modular insulating concrete forms of the type which receive poured concrete and are abandoned in place after pouring, thereby becoming an integral part of a static structure being built. The invention is particularly applicable to residential and light commercial construction. The novel forms are usable by homeowners, contractors, municipal, industrial, and institutional personnel in building and improving existing structures wherever insulated load bearing walls are to be built from poured concrete.

2. Description of the Prior Art

Left-in-place insulting concrete forms for building foundations and load bearing walls from poured concrete are known. In commercial practice, courses of forms are stacked until the final desired height of a wall is attained. Concrete is poured into the erected forms and allowed to cure. Erection of multi-course forms prior to pouring concrete must be carefully performed. It is necessary that the forms be properly aligned with respect to one another to assure that finished wall surfaces are flat and flush. Also, opposing exterior panels of each form section must be held in place without distortion of overall configuration of the form. Foundations and walls usually describe a closed perimeter. That is, a foundation or building wall has typically four sides, although this may vary, which sides intersect at corners.

One of the significant problems with prior art forms is that they are not designed such that location of tie brackets coincides with the ends of standard building elements. Illustratively, sheets of plywood and gypsum wall board are provided with length of eight feet and width of four feet. If a form section has tie brackets and associated plates or flanges, which plate or flange serves as a structural member which can receive driven and threaded fasteners, located at each end of the form section, abutment of two form sections results in abutting plates or flanges. This arrangement typically disturbs regular spacing of tie brackets, and makes it difficult to properly locate fastening positions for attaching building elements to the form.

Another problem is that the prior art has not provided corner forms which are conducive to laying a wall in increments of four feet, as measured from the outside corner, as is frequent commercial practice. Prior art forms typically require shortening by cutting to accommodate building walls laid out in increments of four feet.

The prior art has not devoted significant effort to is designing forms to accommodate the various problems which are associated with corners of forms. In most cases, the thrust of prior art forms concentrates on maintaining perpendicularity or roundness of the corner, as the particular design may warrant. Examples are seen in U.S. Pat. Nos. 4,706,429 and 4,866,891, issued to David A. Young respectively on Nov. 17, 1987, and Sep. 19, 1989, and 4,949,515, issued to Edmond D. Krecke on Aug. 21, 1990. Young shows corner forms which accommodate rounded corners. Krecke shows bracing at perpendicular corners. These prior art designs are not conducive to building in four foot increments and also fail to show an optional vertical corner bracket shown in the present invention.

None of the above inventions and patents, taken either singly or in combination, is seen to describe the instant invention as claimed.

SUMMARY OF THE INVENTION

The present invention provides a corner form which both enables ready installation of construction elements such as sheets of plywood fabricated in increments of four feet and also enables walls and foundations to be laid out in increments of four feet. These goals are accomplished by locating reinforcing brackets at one foot intervals measured from the corner, and by providing overall length dimensions of the legs which when summed equal increments of four feet in combined lengths. The corner form interlocks with both the corner form directly below and also with a straight form directly below which abuts the lower corner form. This is an important advance in the art since overall straightness and integrity of the corner and other sections final foundation or wall formed by filling the form with concrete are significantly better than those of prior art forms lacking the inventive features.

Each form has tie brackets connecting inner and outer insulating panels. Each tie bracket has a flange disposed parallel to its associated panel which serves both as an embedded anchor fixing the tie bracket solidly to each insulating panel and also as a structural member which can receive threaded and driven fasteners for installing standard building elements to the built up form. Outermost tie brackets are located well inside the ends of the form so that abutment of adjacent form sections avoids interference of adjacent tie brackets. The tie brackets are located at one foot intervals, the first being one half foot from the end of the form, thereby placing the first tie bracket of two adjoining forms at a one foot interval, maintaining a constant spacing.

The corner form has interfitting projections formed in the upper surface of the form and corresponding notches formed in the lower surface thereof. Each notch is located directly below a projection. Projections of one form come to seat within the notches of a form placed thereon.

The interlocking projections and notches are located on each form such that forms can be placed both directly above one another, and more preferably, in overlapping orientation, and will still interlock. The projections and notches are spaced apart at intervals appropriate for forming walls in increments of four feet. This feature is likely to save considerable time and effort in erecting walls because many contemporary residential and commercial designs are predicated on increments of four feet.

In a further aspect, the present invention sets forth a construction of the corner incorporating a vertical open shaft for receiving a reinforcement element, such as metal pipe. This feature assists in maintaining even and solid a wall built up from stacked courses of form sections. An optional, structurally strong vertical reinforcing and attachment bracket may be imbedded into the area of the open shaft and occupies the corner of a corner form, in place of the open shaft.

Accordingly, it is one object of the invention to provide a corner form which accommodates walls and foundations laid out in increments of four feet.

An additional object of the invention is to enable ready placement and fastening of standard building elements such as plywood and gypsum wall board based upon dimensions in increments of four feet.

Yet another object of the invention is to minimize the amount of cutting and modifying of forms which is necessary.

It is another object of the invention to be able to interlock form sections while overlapping one form over another.

Still another object of the invention is to provide an optional vertical reinforcing and attachment bracket which occupies the corner of a corner form.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
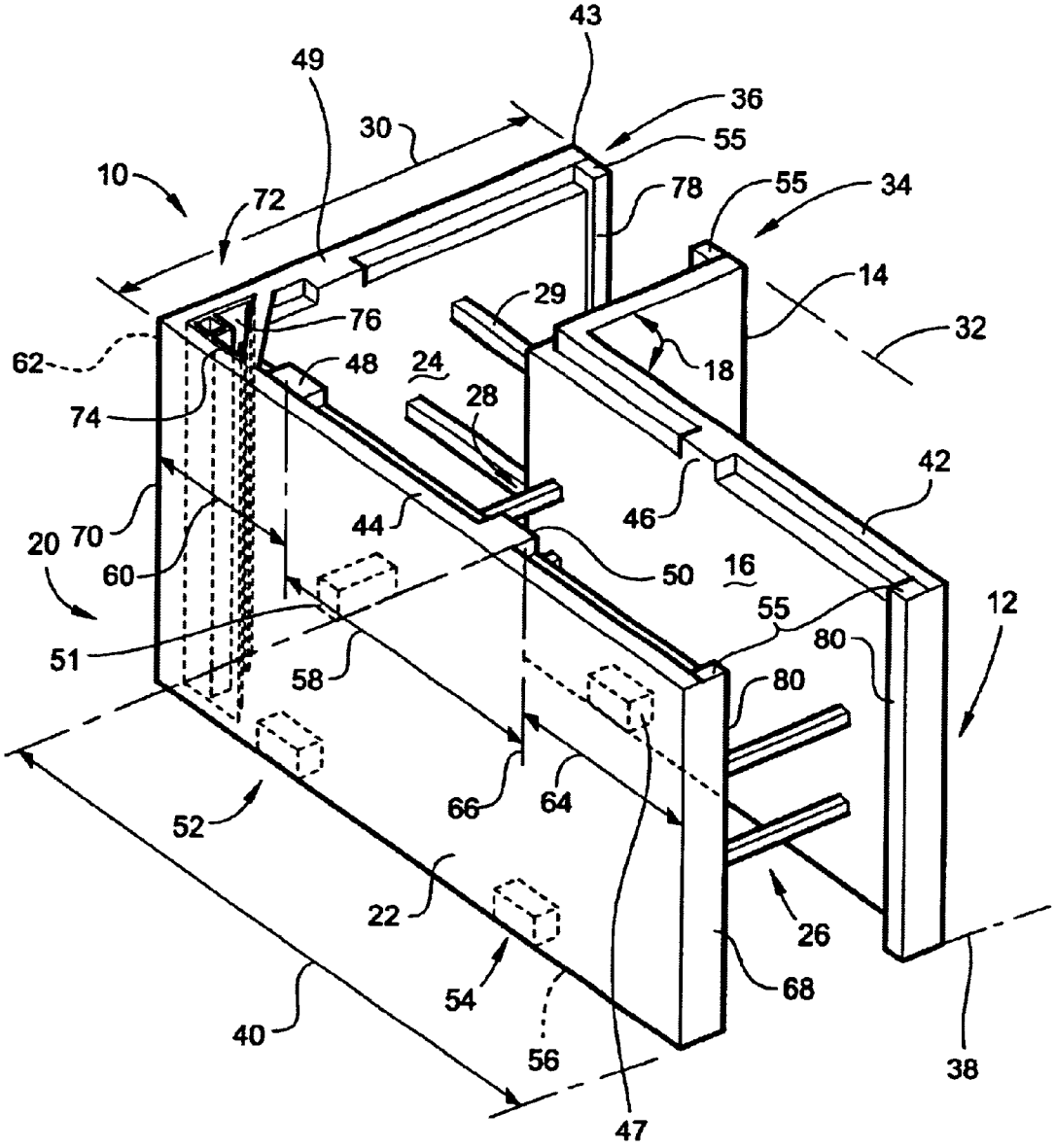
FIG. 1 is a perspective view of one embodiment of a corner form according to the present invention.

FIG. 1 of the drawings shows the essential nature of a corner form 10, which forms a corner in a form system (not shown in its entirety) for receiving poured concrete. Corner form 10 includes an interior insulating panel 12 formed from expanded foam, having a first leg 14 and a second leg 16. Legs 14, 16 are straight and perpendicular to one another, and form an oblique angle 18 included between and within legs 14, 16. An exterior insulating panel 20 formed from expanded foam has a first leg 22 and a second leg 24 which are preferably straight and parallel to legs 14, 16 of panel 12, and form a similar oblique angle included between and within legs 22 and 24. Panels 12, 20 are connected and held in spaced apart, parallel orientation by tie brackets 26, 28, 29, which include members embedded within panels 12, 20. Only cross members of tie brackets 26, 28, 29 spanning panels 12, 20 are visible.

It will be seen that legs 14 and 16 of interior panel 12 are different in length. Similarly, legs 22, 24 of panel 20 are different in length. In most cases, to conform to general building practices, oblique angle 18 is a right angle. Legs 14, 24 of panels 12, 20 terminate in a plane parallel to leg 16 of interior panel 12. The effective length of legs 14, 24 is indicated by dimension 30. Projection line 32, which coincides with the free end 34 of leg 14 and free end 36 of leg 24, also indicates the aforementioned plane.

In similar vein, second legs 16, 22 of respective panels 12, 20 terminate in a second plane which is parallel to first leg 14 of panel 12. The second plane is indicated in part by projection line 38. Effective length of legs 16, 22 of panels 12, 20 (respectively) is indicated by dimension 40. The combined effective lengths of legs 22 and 24 is four feet. The length indicated by dimension 40 is preferably thirty inches, while the length indicated by dimension 30 is preferably eighteen inches.

Figure 2:
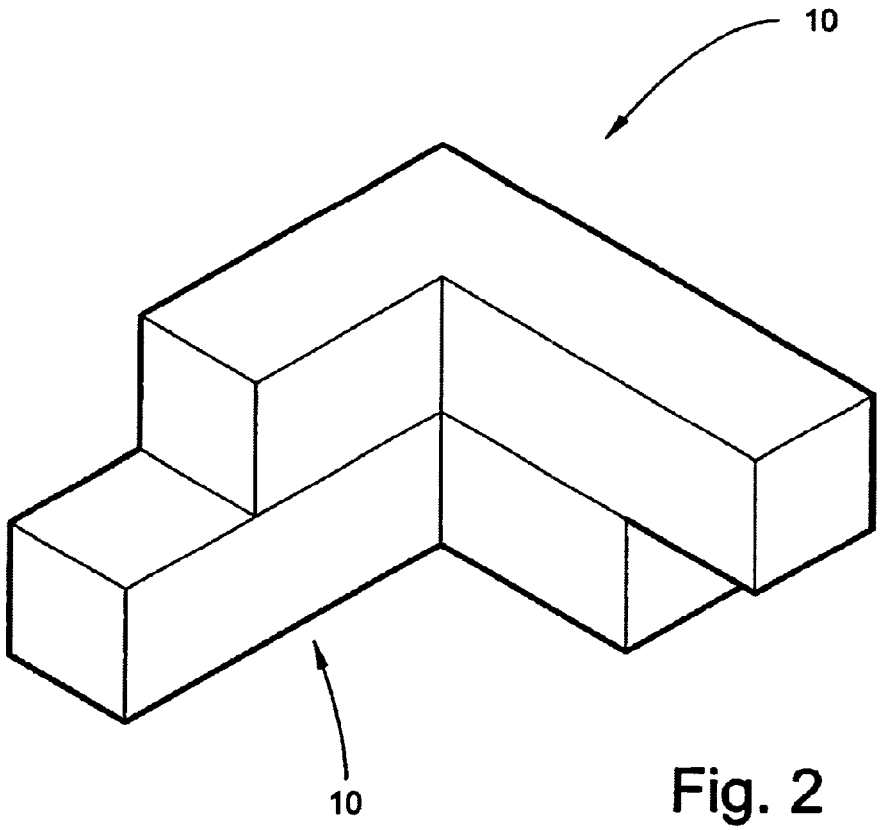
FIG. 2 is a diagrammatic perspective view of two corner forms of the embodiment of FIG. 1 shown joined together in an arrangement suitable for interlocking to still other forms.

Panels 12, 20 each have a respective upper surface 42, 44. A projection 46 is formed in surface 42, and two projections 48, 50 are formed in surface 44. A projection 49 is formed in surface 43. Notches 52, 54 are formed in the lower surface 56 of leg 22, while a notch 47 is formed in the lower surface of leg 16 and a notch 51 is formed in the lower surface of leg 24. Notches 52, 54 are located directly below corresponding projections 48, 50, notch 47 is located directly below corresponding notch 46, and notch 51 is located directly below projection 49 and are configured to receive projections in close cooperation therewith. An end projection 55, having one half the length of projections 46, 48, 50 and 49, is located on each of the four upper ends of panels 14, 16, 22 and 24. Each end projection 55 is configured to occupy one half of a notch, with the end projection of a straight form occupying the other half of the same notch. Plural corner forms 10 can be stacked in the manner shown in FIG. 2 and interlocked by interfitting a projection of one corner form 10 into a notch of the corner form 10 above.

Notches 52, 54 and projections 48, 50 are spaced apart regularly from one another by a distance interval 58 which is twice the magnitude of distance interval 60 existing between notch 52 and the end 62 of panel 20. Similarly, distance interval 64, which spans the center line 66 of notch 54 and end 68 of panel 20 is half the magnitude of distance interval 58. Although the number of notches and projections can be varied to suit, it will be seen that the notches of panel 20 collectively include a first end notch adjacent to only one other notch and a second end notch adjacent to only one other notch, where there are at least two notches. Distance interval 58, which is that by which adjacent notches 52, 54 are spaced apart, is equal in magnitude to a distance taken on centers which are whole number multiples of linear measurements of one foot. This characteristic leads to being able to utilize corner form 10 in modular fashion, and to minimize cutting of forms 10 when fabricating walls and foundations in increments of one foot.

Figure 4:
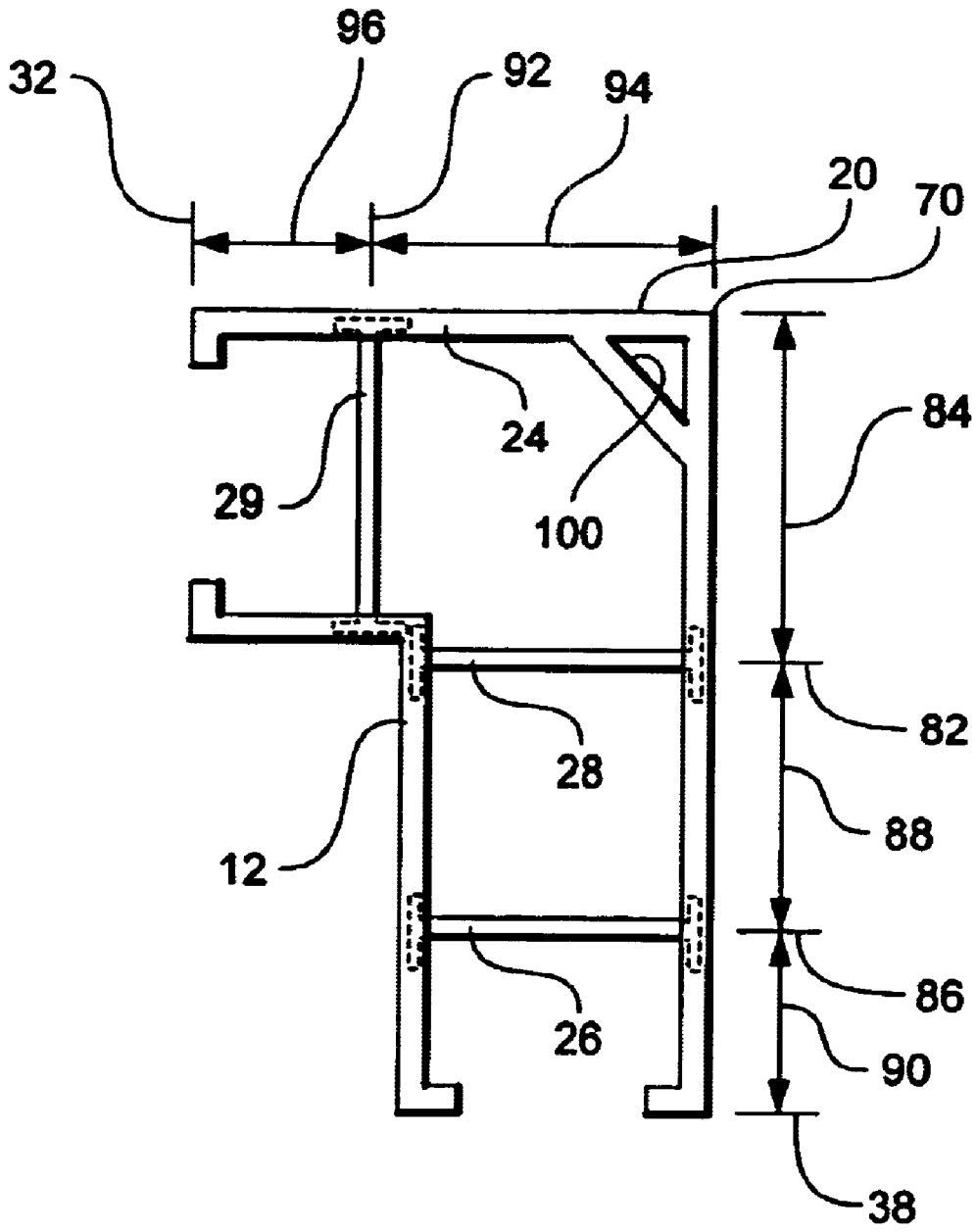
FIG. 4 is a diagrammatic, top plan view of FIG. 1.

FIG. 4 shows spacing of tie brackets 26, 28, 29. Measuring from corner 70 of exterior panel 20, center line 82 of tie bracket 28 is located at a distance interval 84 of one foot from the end of leg 24. Center line 86 of tie bracket 26 is located at a distance interval 88 from center line 82, and at a distance interval 90 of six inches from projection line 38 which indicates the end of form 10. In a similar manner, center line 92 of tie bracket 29 is separated by a distance interval 94 of one foot from corner 70, and by a distance interval 96 of six inches from projection line 32.

Of course, it is not critical that the center lines 82, 86, 92 of tie brackets 26, 28, 29 coincide with the visible portions thereof. Rather, it is important that center lines 26, 28, 29 pass through the centers of the flat plates 26*a*, 26*b*, 28*a*, 28*b*, 29*a* and 29*b*, (shown in phantom in FIG. 4) of the tie brackets. It will be appreciated that tie brackets have end plates which are embedded within insulating panels 12, 20 to anchor the tie brackets within insulating panels 12, 20. These plates provide broad, flat surfaces typically parallel to the outer surfaces of legs 22, 24 of exterior panel 20 to which fasteners (not shown) may be engaged by threading and friction. It is strongly desirable that these plates be located on one foot centers, measuring from corner 70, for the purpose of enabling craftsmen to affix construction elements such as plywood and gypsum wall board sheets (neither shown) to a wall built utilizing form 10. This is readily accomplished by placing a construction element against the form and nailing or otherwise fastening the construction element at one foot to the form.

In summary, it will be seen that the center line of each tie bracket 28 or 29 which is adjacent to corner 70 is spaced apart from corner 70 by a distance interval which is a whole number multiple of one foot. Each tie bracket of any one leg is spaced apart from every adjacent tie bracket by a distance interval which is a whole number multiple of measurements of one foot. The foregoing holds true regardless of the actual number of tie brackets provided and of the overall length of each leg of the corner form.

Figure 3:
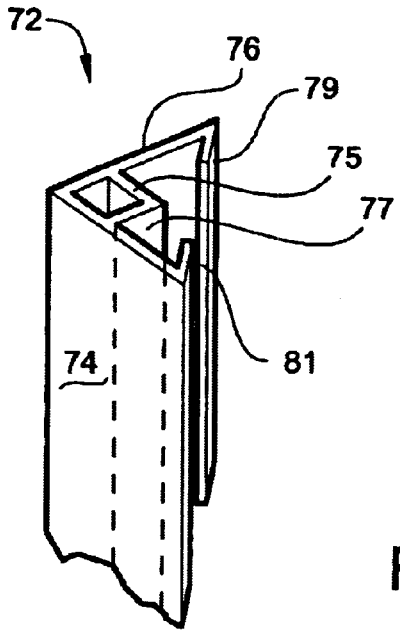
FIG. 3 is a perspective detail view of an optional reinforcing bracket shown at the left of FIG. 1.

Looking now at the left of FIG. 1, it will be seen that corner 70 is formed at the intersection of legs 22, 24. A vertical bracket 72 is optionally embedded within exterior panel 20 at a vertical opening 100 (see FIG. 4) formed at corner 70. Referring also to FIG. 3, bracket 72 includes a first plate 74 disposed parallel to leg 22 and a second plate 76 disposed parallel to leg 24 of panel 20. Plates 74, 76 both reinforce the corner of form 10 and also provide fastener receiving surfaces similar in function to the plates of tie brackets 26, 28, 29 (see FIG. 4). Bracket 72 preferably includes webs bracing and reinforcing plates 74, 76.

Corner form 10 also includes bulkhead retainers 78, 80 formed on the legs of panels 12, 20. Retainers 78, 80 may comprise any structure which would surround or otherwise entrap a flat panel placed just within the ends of the form to close the otherwise open ends. The precise nature of retainers 78, 80 is not critical to their function.

It is to be understood that the present invention is not limited to the embodiments described above, but encompasses any and all embodiments within the scope of the following claims.

I claim:

1. A corner form for forming a corner in a form system for receiving poured concrete, comprising:

an interior insulating panel formed from expanded foam, having a first leg and a second leg together forming a unitary panel and forming a first angle included between and within said first leg and said second leg;

an exterior insulating panel formed from expanded foam, having a first leg and an intersecting second leg together forming a unitary panel and forming a second angle included between and within said first leg and said second leg, wherein said first leg and said second leg of said exterior insulating panel form a corner edge where they intersect; and at least one unitary tie bracket having flat plates on either end, connecting and spacing apart said interior insulating panel and said exterior insulating panel and spanning a space therebetween, and said flat plates being embedded in said first and second leg of both said interior insulating panel and said exterior insulating panel, wherein said first leg of said exterior panel is of a length different from that of said second leg of said exterior panels; and a vertical bracket embedded proximate the intersection of said first leg and said second leg of said exterior insulating panel, wherein said vertical bracket comprises a first plate parallel to said first leg and a second plate parallel to said second leg, said first and second plates extending the full height of said interior and exterior insulating panel;

and wherein said first and second plates, of said vertical bracket, abut to form an angle congruent with said first angle formed by the first and second legs of said interior insulating panel.

2. The corner form according to claim 1, wherein said first and second angles each are one of the group: a right angle, an obtuse angle and an acute angle, and said first leg of said interior insulating panel and said first leg of said exterior insulating panel each are straight and terminate in a plane parallel to said second leg of said interior insulating panel.

3. The corner form according to claim 2, wherein said second leg of said interior insulating panel and said second leg of said exterior insulating panel each are straight forming a flat wall and terminate in a plane parallel to said first leg of said interior insulating panel.

4. The corner form according to claim 1, wherein combined effective lengths of said first leg of said exterior panel and of said second leg of said exterior panel equal for four feet.

5. The corner form according to claim 1, wherein said interior insulating panel and said exterior insulating panel each have an upper surface, at least one projection formed in said upper surface, a lower surface, and a number of notches formed in said lower surface corresponding to the number of said projections, wherein each said notch is dimensioned and configured to matingly receive said projection therein in close cooperation therewith, and each said notch is directly below one said projection.

6. The corner form according to claim 1, wherein the center line of each said tie bracket which is adjacent to said corner edge is spaced apart from said corner edge by a distance interval which is a whole number multiple of one foot, and wherein said first leg of said exterior insulating panel has a length of eighteen inches and said second leg of said exterior insulating panel has a length of thirty inches.

7. The corner form according to claim 6, wherein each said tie bracket is spaced apart from every adjacent said tie bracket by a distance interval which is a whole number multiple of measurements of one foot.

8. The corner form according to claim 7, wherein said exterior panel has a vertical opening formed at said corner at the intersection of said first leg and said second leg of said exterior insulating panel.

9. The corner form according to claim 8, further comprising a vertical bracket embedded within said vertical opening of said exterior panel, wherein said vertical bracket comprises a first plate parallel to said first leg and a second plate parallel to said second leg, said plates extending the full height of said vertical bracket; and wherein said first and second plates abut to form an angle congruent with said first angle formed by the first and second legs of said interior insulating panel.

10. The corner form according to claim 8, further comprising a first bulkhead retainer formed on said first leg of said exterior panel, a second bulkhead retainer formed on said second leg of said exterior panel, a third said first and second angles are right angles, said first leg of said interior insulating panel and said first leg of said exterior insulating panel each are straight forming a flat wall and terminate in a plane parallel to said second leg of said interior insulating panel, and said second leg of said interior insulating panel and said second leg of said exterior insulating panel each are straight and terminate in a plane parallel to said first leg of said interior insulating panel, said interior insulating panel and said exterior insulating panel each have an upper surface, at least one projection formed in said upper surface, a lower surface, and a number of notches formed in said lower surface corresponding to the number of said projections, wherein each said notch is dimensioned and configured to matingly receive said projection therein in close cooperation therewith, and each said notch is directly below one said projection, the center line of each said tie bracket which is adjacent to said corner edge is spaced apart from said corner edge by a distance interval which is a whole number multiple of one foot, and each said tie bracket is spaced apart from every adjacent said tie bracket by a distance interval which is a whole number multiple of measurements of one foot; and a vertical bracket embedded proximate the intersection of said first leg and said second leg of said exterior insulating bulkhead retainer formed on said first leg of said interior panel, and a fourth bulkhead retainer formed on said second leg of said interior panel for receiving a bulkhead during pouring of concrete.

11. A corner form for forming a corner in a form system for receiving poured concrete, comprising:

an interior insulating panel formed from expanded foam, having a first leg and a second leg together forming a unitary panel and forming a first angle included between and within said first leg and said second leg;

an exterior insulating panel formed from expanded foam, having a first leg and an intersecting second leg together forming a unitary panel and forming a second angle included between and within said first leg and said second leg, and wherein said first leg and said second leg of said exterior insulating panel form a corner edge where they intersect; and at least one unitary tie bracket having flat plates on either end thereof connecting and spacing apart said interior insulating panel and said exterior insulating panel and spanning a space therebetween, and said flat plates being embedded in said first and second leg of both said interior insulating panel and said exterior insulating panel, panel, wherein said vertical bracket comprises a first plate parallel to said first leg and a second plate parallel to said second leg, said first and second plates extending the full height of said interior and exterior insulating panels;

and wherein said first and second plates, of said vertical bracket, abut to form an angle congruent with said first angle formed by the first and second legs of said interior insulating panel.

12. The corner form of claim 11 wherein said exterior panel has a vertical opening formed at said corner at the intersection of said first leg and said second leg of said exterior insulating panel, and said vertical opening contains a vertical bracket embedded there within, wherein said vertical bracket comprises a first plate parallel to said first leg and a second plate parallel to said second leg; and wherein said first and second plates abut to form an angle congruent with said first angle formed by the first and second legs of said interior insulating panel.

13. A corner form for forming a corner in a form system for receiving poured concrete, comprising:

an interior panel, having a first leg and a second leg together forming a unitary panel and forming a first angle included between and within said first leg and said second leg;

an exterior panel, having a first leg and an intersecting second leg together forming a unitary panel and forming a second angle included between and within said first leg and said second leg, wherein said first leg and said second leg of said exterior insulating panel form a corner edge where they intersect; and a plurality of unitary tie brackets having flat plates on either end thereof, connecting and spacing apart said interior insulating panel and said exterior insulating panel and spanning a space therebetween, and said flat plates being embedded in said first and second leg of both said interior insulating panel and said exterior insulating panel, wherein said first leg of said exterior panel is of a length different from that of said second leg of said exterior panel; and said first leg of said interior insulating panel and said first leg of said exterior insulating panel each are straight and terminate in a plane parallel to said second leg of said interior insulating panel; and wherein said interior insulating panel and said exterior insulating panel each have an upper surface, at least one projection formed in said upper surface, a lower surface, and a number of notches formed in said lower surface corresponding to the number of said projections, wherein each said notch is dimensioned and configured to matingly receive said projection therein in close cooperation therewith, and each said notch is directly below one said projection; and a vertical bracket embedded in expanded foam proximate the intersection of said first leg and said second leg of said exterior insulating panel, wherein said vertical bracket comprises a first plate parallel to said first leg and a second plate parallel to said second leg, said first and second plates extending the full height of said interior and exterior insulating panels;

and wherein said first and second plates, of said vertical bracket, abut to form an angle congruent with said first angle formed by the first and second legs of said interior insulating panel.

14. The corner form according to claim 13, wherein the center line of each said tie bracket which is adjacent to said corner edge is spaced apart from said corner edge by a distance interval which is a whole number multiple of one foot, and wherein said first leg of said exterior insulating panel has a length of eighteen inches and said second leg of said exterior insulating panel has a length of thirty inches.

15. The corner form according to claim 14, wherein each said tie bracket is spaced apart from every adjacent said tie bracket by a distance interval which is a whole number multiple of measurements of one foot.

16. The corner form according to claim 15, wherein said exterior panel has a vertical opening formed at said corner at the intersection of said first leg and said second leg of said exterior insulating panel, and said vertical opening contains a vertical bracket embedded there within, wherein said vertical bracket comprises a first plate parallel to said first leg and a second plate parallel to said second leg; and said plates extending the full height of said vertical bracket; and wherein said first and second plates abut to form an angle congruent with said first angle formed by the first and second legs of said interior insulating panel.

17. The corner form of claim 16 wherein, the centerline of each tie bracket measures exactly twelve inches from the corner edge.

18. The corner form of claim 17 further comprising a vertical bracket embedded within said vertical opening of said exterior panel, wherein said vertical bracket comprises a first plate parallel to said first leg and a second plate parallel to said second leg, said plates extending the full height of said vertical bracket; and wherein said first and second plates abut to form an angle congruent with said first angle formed by the first and second legs of said interior insulating panel.

19. The corner form of claim 18 wherein said interior panel and said exterior panel are formed from an insulating, expanded foam.

20. The corner form of claim 17 wherein said first and second angles of said exterior panel each are one of the group:

a right angle, an obtuse angle and an acute angle.

* * * * *